US012178286B2

(12) United States Patent
Cherif-Cheikh

(10) Patent No.: US 12,178,286 B2
(45) Date of Patent: Dec. 31, 2024

(54) DEVICE FOR ATTACHING REMOVABLE INTERCHANGEABLE HEELS FOR SHOES WITH TWO SPRINGS

(71) Applicant: Margaux Cherif-Cheikh, Paris (FR)

(72) Inventor: Margaux Cherif-Cheikh, Paris (FR)

( * ) Notice: Subject to any disclaimer, the term of this patent is extended or adjusted under 35 U.S.C. 154(b) by 95 days.

(21) Appl. No.: 15/733,199

(22) PCT Filed: Dec. 27, 2018

(86) PCT No.: PCT/FR2018/000272

§ 371 (c)(1),
(2) Date: Sep. 8, 2020

(87) PCT Pub. No.: WO2019/129938

PCT Pub. Date: Jul. 4, 2019

(65) Prior Publication Data

US 2024/0225194 A1 Jul. 11, 2024

(30) Foreign Application Priority Data

Dec. 28, 2017 (FR) ..... 1771439

(51) Int. Cl.
*A43B 21/39* (2006.01)
*A43B 21/47* (2006.01)

(52) U.S. Cl.
CPC ..... *A43B 21/39* (2013.01); *A43B 21/47* (2013.01)

(58) Field of Classification Search
CPC ..... A43B 21/36; A43B 21/37; A43B 21/39; A43B 21/40; A43B 21/47
USPC ..... 36/42
See application file for complete search history.

(56) References Cited

U.S. PATENT DOCUMENTS 522,234 A * 7/1894 Schrader ..... A43B 21/39 36/42
908,088 A * 12/1908 Gerlach ..... A43B 21/39 36/42
1,044,222 A * 11/1912 Mladezki et al. ..... A43B 21/37 36/36 R (Continued)

FOREIGN PATENT DOCUMENTS

FR 1 409 019 A 8/1965
FR 2 907 318 A1 4/2008

(Continued)

OTHER PUBLICATIONS

International Search Report as issued in International Patent Application No. PCT/FR2018/000272, dated Mar. 20, 2019.

*Primary Examiner* — Heather Mangine
(74) *Attorney, Agent, or Firm* — Pillsbury Winthrop Shaw Pittman LLP

(57) ABSTRACT

A device for attaching removable interchangeable heels for shoes. A system for locking and unlocking interchangeable heels in order to change heels as desired, while keeping the same pair of shoes, includes a base with tenon, called the housing, wherein a flat locking spring is located, and a mortise part wherein a second flat spring is inserted. The mortise and tenon assembly is locked when the two flat springs, having complementary shapes, come into contact and immobilize one another. The user can act on the tab of the locking flat spring in order to rotate it and unlock the heel. The flat spring automatically returns to its initial position due to its elasticity, when the user releases it.

11 Claims, 6 Drawing Sheets

(56) References Cited

U.S. PATENT DOCUMENTS 1,396,299 A * 11/1921 Summerfield ..... A43B 21/37 36/41
1,426,019 A * 8/1922 Summerfield ..... A43B 21/39 36/42
1,647,444 A * 11/1927 Hadaway ..... A43B 21/06 36/35 R
1,709,749 A * 4/1929 Shahbender ..... A43B 21/40 36/36 R
1,829,252 A * 10/1931 Zubia ..... A43B 21/36 36/42
2,076,978 A * 4/1937 Butler ..... A43B 21/47 36/36 R
2,195,324 A * 3/1940 Brunmark ..... A43B 21/39 36/42
2,224,476 A * 12/1940 Farina ..... A43B 21/38 36/42
2,285,254 A * 6/1942 Da Silva ..... A43B 21/39 36/36 R
2,285,738 A * 6/1942 Melchionna ..... A43B 7/144 36/76 R
2,431,868 A * 12/1947 Gilmour ..... A43B 21/39 12/142 F
2,945,311 A * 7/1960 Cesta ..... A43B 21/37 36/36 R
3,581,413 A * 6/1971 Simonetti ..... A43B 21/39 36/42
3,754,340 A * 8/1973 Pais ..... A43B 21/37 36/42
3,797,136 A * 3/1974 Soleri ..... A43B 21/50 36/42
4,198,770 A * 4/1980 Orea Mateo ..... A43B 13/34 36/36 A
4,667,421 A * 5/1987 Rouhani ..... A43B 21/51 36/36 C
4,805,320 A * 2/1989 Goldenberg ..... A43B 21/52 36/36 R
5,456,026 A * 10/1995 Lewis ..... A43B 21/36 36/36 R
5,519,950 A * 5/1996 Wang ..... A43B 21/40 36/36 R
6,711,835 B1 * 3/2004 Militello ..... A43B 21/42 36/36 B
7,954,256 B2 * 6/2011 Colella ..... A43B 3/24 36/15
9,877,537 B2 * 1/2018 Berberian ..... A43B 13/28
11,311,078 B2 * 4/2022 Patel ..... A43B 13/141
2013/0019498 A1 * 1/2013 Causey ..... A43B 21/51 36/42
2013/0067770 A1 * 3/2013 Sherwood ..... A43B 21/39 36/100

FOREIGN PATENT DOCUMENTS

FR 3 062 035 A1 7/2018
GB 235116 A * 6/1925
GB 285768 A * 10/1927
WO WO-2018152607 A1 * 8/2018 ..... A43B 21/36

* cited by examiner

DEVICE FOR ATTACHING REMOVABLE INTERCHANGEABLE HEELS FOR SHOES WITH TWO SPRINGS

CROSS-REFERENCE TO RELATED APPLICATIONS

This application is the U.S. National Stage of PCT/FR2018/000272, filed Dec. 27, 2018, which in turn claims priority to French patent application number 1771439 filed Dec. 28, 2017. The content of these applications are incorporated herein by reference in their entireties.

The present invention relates to the field of shoes, and more particularly, to shoes with heels. It aims to allow the interchangeability of heels in order to be able to easily and quickly vary heights, colors and heel shapes, according to the user's desire, while keeping the same pair of shoes, thanks to a mechanism fixed on the sole at the back of the shoe and in the heel.

The invention relates to a device for attaching removable interchangeable heels on shoes with a simple and economical mechanism under the shoe, at the heel position.

Many interchangeable heel systems are known. However, these mechanisms are most often complex, expensive, impractical and sometimes seem weak.

This device is an improvement of the patent application FR1770083 already filed by us.

Indeed, this new mechanism allows better resistance to an external force and therefore better fixation of the heel on the shoe. Instead of a notch in the mortise part simply adapted to the locking protruding member of the spring and often machined in the same material as the heel, rigid, we have just added a second spring of complementary shape allowing a resistant and elastic assembly. This second spring avoids a complete rise of the locking protruding member of the locking flat spring, during a significant impact or the application of a continuous external force. The deformation of the second spring in response to a force allows verticalization of its arms and therefore an improvement in the locking of the two springs between them. The first device described in patent application FR1770083 can be unlocked more easily when a force of more than 350 Newton is applied, because the locking protruding member against a rigid material can rise due to its inclination. The specificity of this new patent is the double spring assembly which can deform and allows to keep the mechanism locked, when applying a force of 550 to 720 Newton, depending on the inclination of the heel, knowing that 500 Newton is the minimum required to test the fixation of heels on basic shoes.

U.S. Pat. No. 4,805,320 shows a mechanism with a flat spring, in a prominent part under the shoe, and a notch in the heel. Besides the lack of information about the shape of the flat spring and its way of fixation under the shoe, the notch in the heel presents the same problem of inclination and rigidity, when applying an important force. In addition, the heel is machined in one piece, which is very difficult to do industrially speaking. Our new mechanism has an external mortise part which is fixed after production. This mortise part is the same for all the heels, when it is fixed in the heels, and implies a lower production cost since we only need to produce heels of basic shapes in which the mortise part of the mechanism is fixed.

FR1409019 presents, on the one hand, a mechanism with a flexible arm. This mechanism does not allow automatic locking of the teat in the heel during the interlocking, and requires an external tool to unlock the mechanism, which is much less practical than the present invention. On the other hand, this mechanism is not assembled by sliding from rear to front on fins but by a simple interlocking: only the teat blocks the assembly from top to bottom, which is much less resistant than a transverse tenon-mortise joint which blocks the assembly in many more directions.

FR1409019 has, on the other hand, a flap assembled on a tenon, with elastic stress. Besides the lack of information concerning the elastic process and the manufacturing method, the mechanism does not allow again the automatic locking of the teat in the heel. In addition, the locking teat seems much too small to properly lock the assembly and because of the rotation of the flap when it is raised, it could even be hardly unlocked if it had a larger dimension.

Advantageously, the present invention comprises forms which allow the unlocking by pushing up the tab and to ease an industrial production thanks to the housing/flat spring and mortise/second flat spring/heel assembly, in addition to a locking solidity thanks to the two springs.

FR2907318, shows a device with a flexible part machined under the shoe and accessible at the front of the heel. However, a disadvantage of this system is that the flexible part allowing the locking and unlocking of the device is directly machined on the catch under the shoe, by cutting the latter. The necessity of the swinging movement when using the mechanism can eventually lead to a break around the fixed part due to its role of axis of rotation. Another disadvantage is that the user must hold the accessible part of the flexible tab, when placing the heel on the shoe, to raise the stud, which is not practical. Finally, the locking stud does not allow real rotation because of its shape and vertical sides.

The present invention aims to solve the problems mentioned above, that is to say to be simpler, more economical, easily achievable industrially and above all, more resistant by proposing a new removable heel assembly system on the shoe thanks to the locking of two flat springs. The addition of a second flat spring in the notch of the mortise piece improves considerably the solidity of the assembly.

The present invention consists in the use of an interchangeable heel locking and unlocking system, with a tenon catch, which will be called the housing wherein a flat locking spring is inserted, also called a clip, as well as a mortise part wherein a second flat spring is inserted.

The tenon-mortise assembly is locked when the two flat springs, thanks to their complementary shapes, come into contact and can't move anymore.

This elastic system is discreetly and easily accessible by the user, on one of the sides of the housing. The accessibility of the system on the anterior side is chosen in priority in order to guarantee the aesthetics and the practical aspect of the shoe. The user can act on the tab of the locking flat spring to rotate and unlock the heel. The flat spring automatically returns to its original position thanks to its elasticity when the user releases it. The mechanism thanks to its two springs' system allows a better fastening of the heel on the shoe because of their adapted shapes and their elastic properties.

According to a particular embodiment:

The housing, made of a rigid and resistant material, can either be directly machined under the sole of the shoe or else fixed into the insole by suitable fasteners, such as bolts or screws, for example, which is a better solution from an economic point of view.

It can be machined to allow precise sliding of the mortise piece, from back to front, along guideway, such as fins and to allow a tenon-mortise type assembly with the mortise piece, thanks to its tenon role. The interlocking movement of the mortise piece on the housing is a transverse movement from back to front.

It can be machined in order to contain the flat locking spring.

This housing can have three openings: a front opening through which the locking spring is inserted and through which it is accessible, a lower opening through which the locking protruding member of the locking spring comes out and an upper notch in which a bent part of the locking spring is locked. These openings can be machined on other sides of the housing if the flat locking spring is positioned differently or has a different shape.

The flat locking spring can be composed of a locking protruding member, an upper locking bent part to be locked into the upper notch of the housing and a bent tab allowing its grip, outside the mechanism.

Advantageously, the flat locking spring is locked in the housing thanks to an axis fixed transversely and thanks to its locking bent upper part, which allows its exact positioning in the housing.

The flat spring can be lengthened by a slightly bent tab allowing it to come out a side of the housing, favorably forward, in order to allow the user to access to it. An angular protruding member, V-shaped, for example, is shaped by a special folding of the flat spring and is meant to lock the system by interlocking in a second flat spring of complementary shape, fixed in the mortise piece of the heel. This protruding member can stick out under the housing thanks to the elastic behavior of the spring in its rest position and can be pushed up by the action of the user's finger when it acts on the tab outside the housing.

The resistance of the flat spring must be lower than the force applied by the user's finger on the tab in order to allow the movement.

Advantageously, the protruding member does not block the sliding of the housing in the mortise part thanks to its particular inclination given by an obtuse angle obtained by folding. This inclination prevents the mechanism jam when the mortise piece slides on the housing.

The mortise piece, also called female part, is adapted in order to fit on the housing and to contain a notch.

It can be machined so as to slide from rear to front on the housing using sliding guides and to fit onto it with precision, in a resistant and suitable manner, thanks to a suitable machining.

It can be either fixed to the heel by suitable fasteners, such as screws for example, which allows it to be identical for all the manufactured heels or else it can be machined directly in the heel.

The final locking is ensured by the suitable notch receiving the protruding member that comes out under the housing. The adapted notch is made by the second flat spring folded and inserted into the notch of the mortise piece.

Unlocking the mortise piece is possible by acting on the end of the locking spring, accessible on one side of the housing, allowing it to be removed towards the rear.

The second flat spring is folded at least three times to have a suitable hollow shape, M-shaped, for example, and to have a complementary shape to the flat locking spring, in order to receive the protruding member of the latter. It can be folded twice more at its ends to create two locking bends allowing it to be positioned exactly and to be locked in the notch of the mortise piece. Its elastic behavior and the assembly of the mortise piece on the heel allow it to lock the final position.

According to an alternative of the invention, the housing with the flat locking spring and the mortise piece with the M-shaped spring can also be placed elsewhere in the mechanism.

The mechanism can indeed work by fastening or machining the housing in the heel and by fastening the mortise piece to the insole of the shoe or by machining it under the sole of the shoe.

In all embodiments, the housing and the mortise piece can be fastened to the elements (insole of the shoe and heel) by fasteners, such as screws, for example.

The locking spring can also have a different shape by changing, for example, its V-shaped protruding member into a hollow shape (like an inverted M shape) and the M-shaped spring can also, for example, be machined as an inverted V shape so to become the locking protruding member. The functions of the 2 springs can thus be easily interchanged.

The shapes and characteristics of the different elements can also differ while meeting the technical constraints of the invention.

An additional advantage of this embodiment is the possibility of changing the first flat spring if it were to be damaged or to break, without the need to change the entire housing, since this elastic system is the most important part of the mechanism and is placed on the most expensive part of the shoe/heel assembly.

BRIEF DESCRIPTION OF THE DRAWINGS:

The present invention will be better understood by studying a particular embodiment by way of example and without limitation, illustrated by the drawings in Appendix, in which:

FIGS. 1 to 3 illustrate an embodiment of the present innovation. A variety of other embodiments can exist regarding the shapes, dimensions, positions of the elements and some characteristics and functions of the elements.

Figure 1:
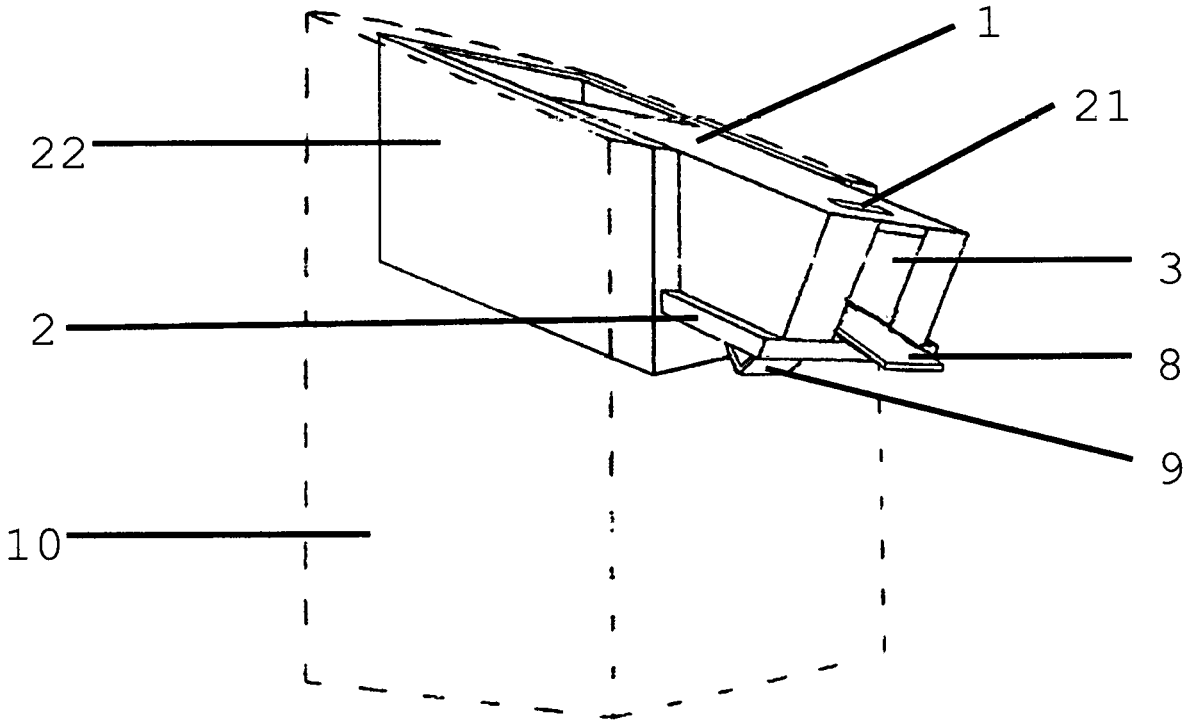
FIG. 1 is a perspective view of an embodiment showing an assembly of the housing, mortise piece and heel (with a dotted line).

The shoe is not shown in the various figures. The heel (10) is shown with a dotted line in FIG. 1. The mortise piece (22) is shown as a full piece in FIG. 1 and as a section in FIGS. 2 and 3.

The fasteners to the shoes and the necessary drilling in the housing (1) are not shown in the figures.

Figure 4A:
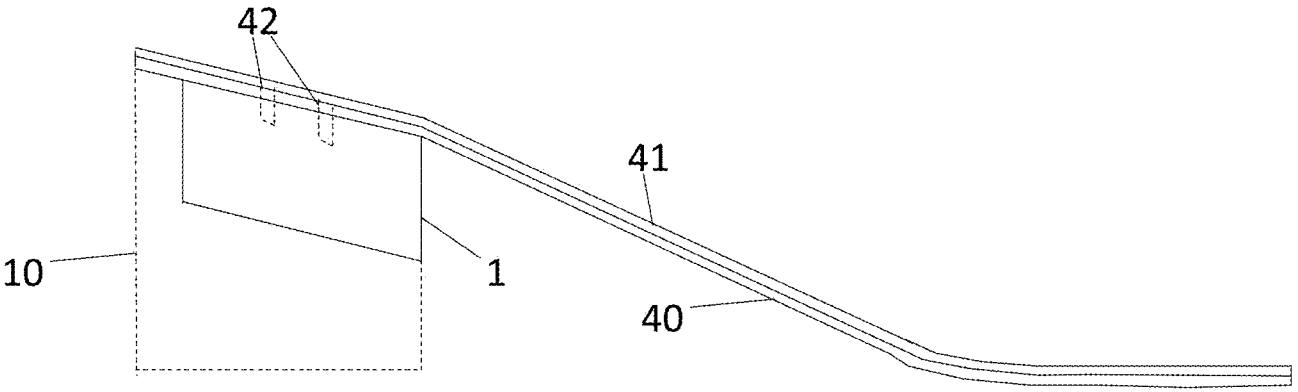
FIGS. 4*a-b* show, respectively, a schematic representation of a housing that is fixed to an insole of the shoe (FIG. 4*a*) or machined under a sole of the shoe (FIG. 4*b*).
Figure 4B:
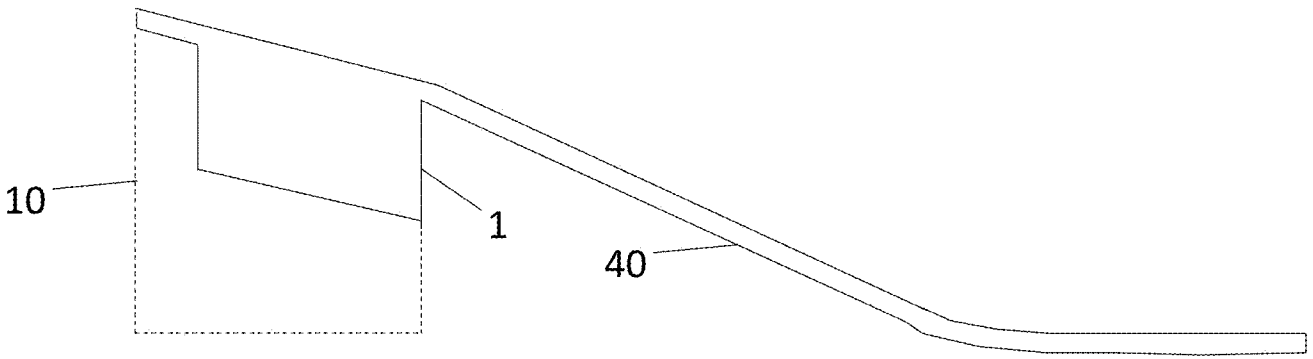
Figure 4C:
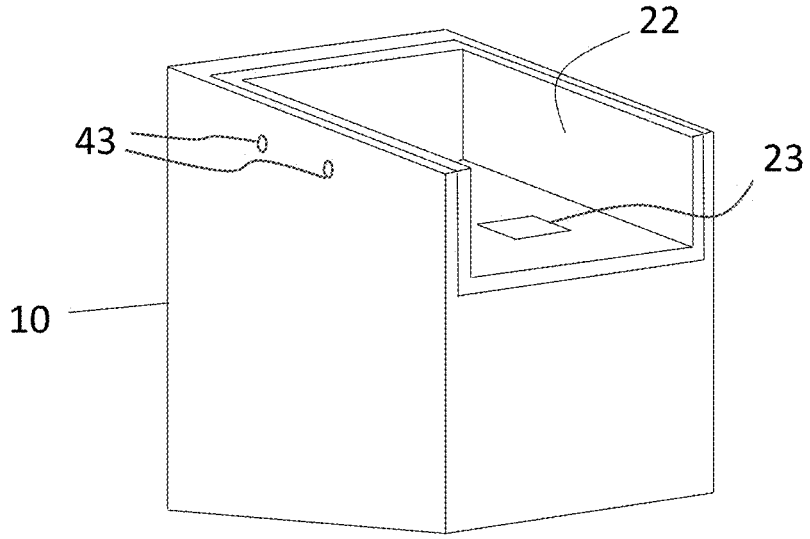
FIGS. 4*c-d* show, respectively, a schematic representation of a mortise piece that is fixed in the removable heel (FIG. 4*c*) or machined in the removable heel (FIG. 4*d*).
Figure 4D:
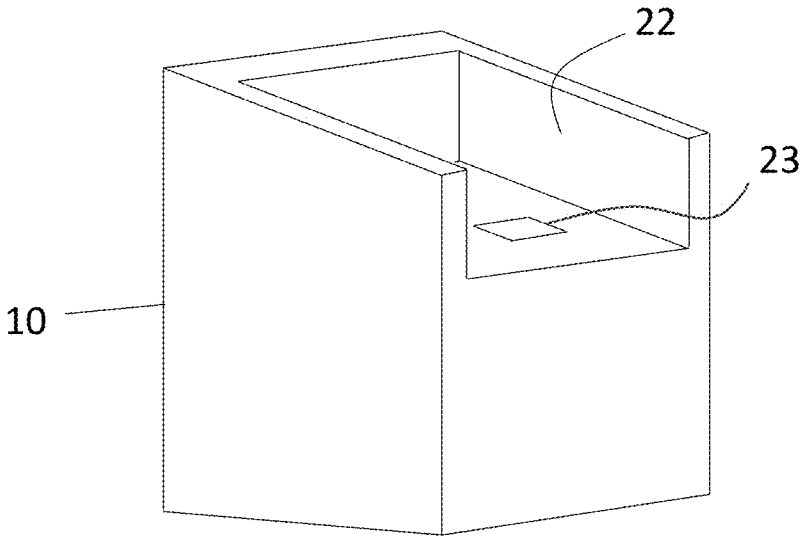

As schematically shown in FIGS. 4*a* and 4*c*, the The housing (1) can be fixed, on the one hand, to the insole (41) of the shoe by fasteners (42) (FIG. 4*a*), such as screws and the mortise part (22) can be fixed to the heel by fasteners (43) (FIG. 4*c*), such as screws. Alternatively, as schematically shown in FIGS. 4*b* and 4*d*, the housing (1) can be machined under a sole (40) of the shoe (FIG. 4*b*) and the mortise piece (22) can be machined in the removable heel (10) (FIG. 4*d*).

The housing must be machined to contain the flat spring (6) and be adapted to its size in order to prevent unwanted movements as much as possible.

The front opening (3) allows the insertion of the flat spring (6) by compressing it during assembly and the grip of the locking spring during its use.

The lower opening (4) allows the locking protruding member (9) to come out of the housing (1) and the upper opening (21) allows a part of the locking spring (7) to be locked.

The housing may include a drilling hole (5) on its left and right sides in order to insert a rigid axis therein making it possible to lock the flat spring (6) in addition to the upper locking bent part (7), which is inserted in the upper notch (21) of the housing.

The flat locking spring (6) was chosen because of its elastic properties and because of its ease of manufacturing and implementation. Advantageously, it can be machined in one piece. Its shape can, however, vary in order to best meet the technical constraints of the device.

Figure 2:
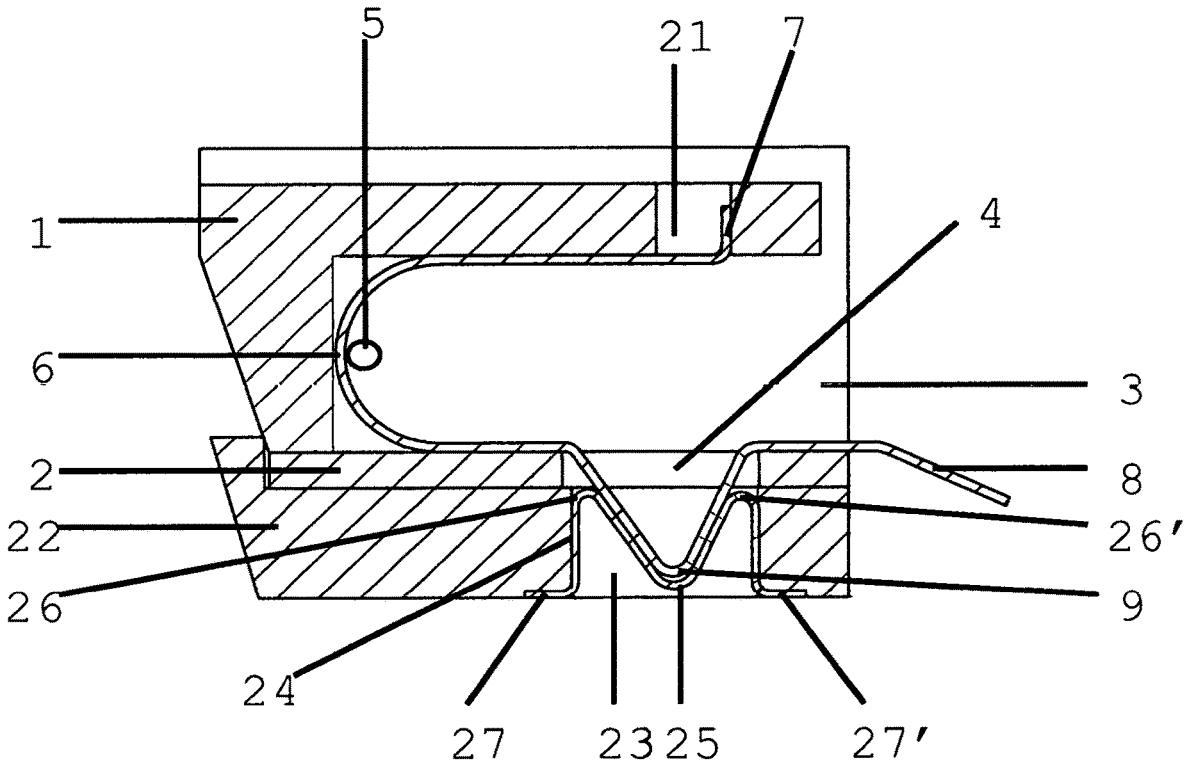
FIG. 2 is a cross-section of the locked tenon-mortise assembly, with a section of the mortise piece.

By way of example, without limitation, it can be machined, as shown in FIG. 2, with a rounded shape with an upper locking bent part (7), with a folded end for the grip which will be called the tab (8) and a lower V-shaped locking protruding member (9).

The upper locking bent part (7) allows to block the spring (6) in the upper part (21) of the housing (1) as well as to help to place the spring in the right position when it is inserted into the housing.

The tab (8) can come out of the housing (1) through the front opening (3) and can be pushed up by the user, which compresses the spring (6) in order to unlock the device. The lower locking protruding member (9) must come out of the housing (1) through the lower opening (4), when the spring is in the rest position. It is machined so as to interlock with the M spring (24) of the mortise piece (22) of the heel (10), which allows to lock the assembly. It can be pushed up in the housing, when the user pushes the tab upwards (8), which compresses the spring (6). It is also machined so as to fully enter into the housing when the spring (6) is compressed.

The protruding member (9) can have any shape allowing an adapted adhesion and locking.

The resistance of the spring (6) is such that the user's finger pressure allow to push up the protruding member (9) (lever arm effect).

The mortise piece (22) fixed on the heel (10) is the removable part of the device. It can have many shapes and heights to be better fixed in the heel.

It is also machined so as to slide easily around the housing (1): the fins (2) of the housing can slide in the sliding guides of the mortise piece (22) and the latter (22) fits precisely on the housing (1), thanks to a special machining for this purpose.

The notch (23) of the mortise piece (22) of the heel (10) must be machined to hold the M spring (24).

The M-shaped spring (24) is a flat spring folded at least three times (25; 26; 26') to have a suitable hollow shape to receive the locking protruding member (9) of the locking spring (6). The folding (26, 26') of the M spring must be adapted to the inclinations of the locking protruding member (9) so that the latter locks there with precision. The M spring (24) can also be folded twice more at its ends in order to create two locking bent parts (27; 27') allowing it to be locked in the notch (23) of the mortise piece (22) of the heel (10).

We will describe the operation of the device when placing the heel, when applying an important external force and then when changing the heel.

During the sliding of the mortise piece (22), and therefore of the heel (10), towards the front on the housing (1), the protruding member (9) comes effortlessly in the housing (1) by compression of the flat spring (6).

The protruding member (9) does not jam the sliding of the housing (1) in the mortise piece (22) of the heel (10) due to its particular inclination given by an obtuse angle.

The protruding member (9), thus, pulled up into the housing, no longer blocks the sliding of the mortise piece (22) and therefore of the heel (10) which can then continue its path until it completely fits on the housing (1).

When the lower opening (4) of the housing (1) is above the notch (23) of the mortise piece (22) of the heel (10), by continuing the movement, the protruding member (9) can then come out thanks to the elastic decompression of the flat spring (6). The protruding member (9) is then positioned in the M spring (24) of the notch (23) of the mortise piece (22), gone along with an audible click for the user, which then locks the shoe/heel assembly (10) or housing (1)/mortise piece (22).

The tab (8) of the spring is then positioned downwards, which, in addition to the audible click, indicates to the user that the protruding member (9) is properly engaged in the heel. This assembly is resistant and can't move. The mortise piece (22) of the heel (10) can remain firmly fixed to the housing (1) of the shoe thanks to the elastic behavior of the flat spring (6) which pushes and locks the protruding member (9) in the M spring (24), when it is at rest.

The heel (10) can then no longer move in the three directions. The sides of the housing (1) and the fins (2) strengthen the assembly, also blocking movement in all directions.

Figure 3:
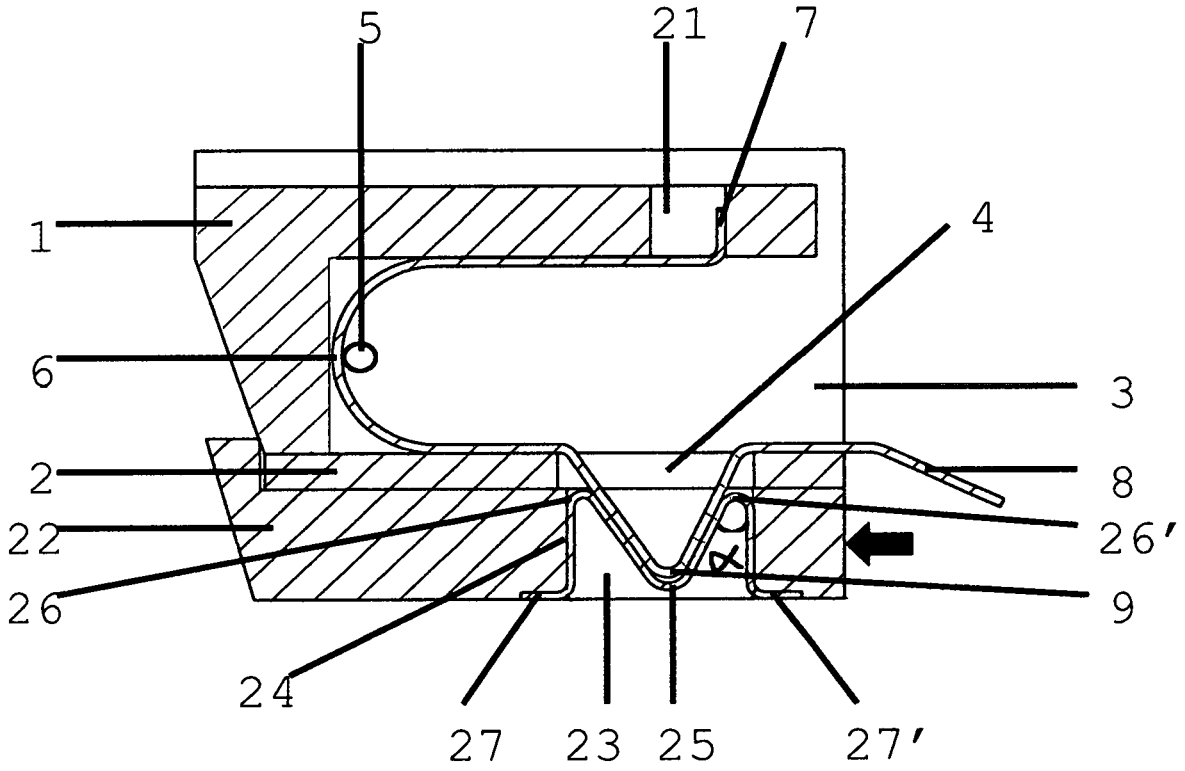
FIG. 3 is a cross-section of the locked assembly when it meets an anterior force.

When the heel meets a significant external force, represented by the arrow in FIG. 3, due, for example, to a jolt against a stair step or a jolt while running, this force will affect the mortise piece (22), the M spring (24) and the locking protruding member (9).

The opposing elastic action of the two springs will add the necessary solidity in order to prevent the separation of the assembly.

Indeed, for example, as shown in FIG. 3, if an external anterior force were to be applied to the heel (10) and therefore to the mortise piece (22), the locking protruding member (9) could be pushed towards the rear, pulled up and unlocks the system.

However, thanks to its elasticity, the M spring (24) could deform and compress the alpha angle. This slight compression would involve a movement of the anterior inclination of the M spring (24) which would then become more vertical. This verticality would then block the thrust of the locking protruding member (9) which could no longer be pulled up.

A greater reaction force would thus further increase the locking of the protruding member (9) in the M spring (24).

The addition of a second spring to the assembly therefore implies an improvement in the locking during the daily use of the device.

In order to separate the heel (10) from the shoe and therefore the mortise piece (22) from the housing (1), the user must push the tab (8) of the flat spring (6) upwards, which compresses it and the protruding member (9) being thus pulled up, the user can slide the heel (10) backwards to remove it from the body of the shoe.

The housing (1) and the mortise piece (22) of FIG. 2 are machined from a solid, non-deformable material. The flat spring (6) and the M spring (24) of FIG. 2 are machined from any metal meeting the technical constraints. These materials must also be light so as not to make the shoe too heavy.

The M spring (24) must be thinner than the locking spring (6) so that it can deform unlike the locking spring (6) which must remain as inert as possible.

Figure 5:
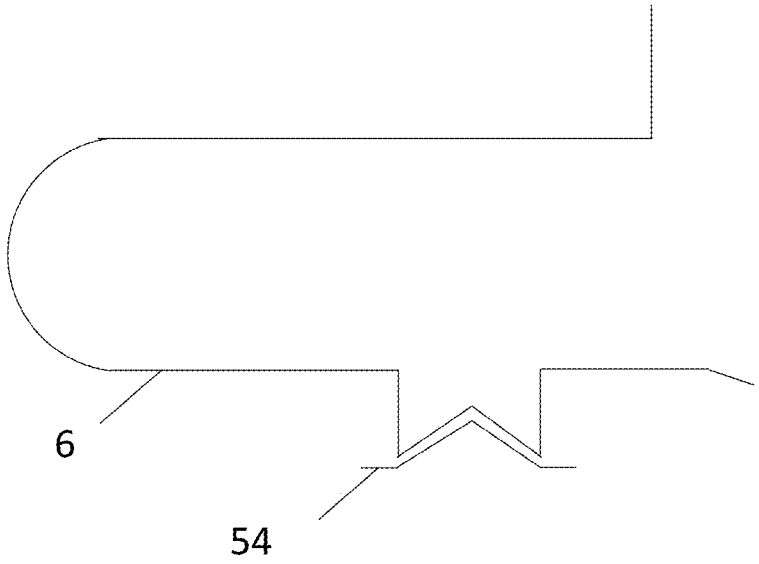
FIG. 5 schematically shows the flat locking spring comprises a hollow part having an inverted M shape and the second spring forming an inverted V.

According to another embodiment, the locking system can be inverted by modifying the locking spring (6) so that it includes a hollow part, like an inverted M shape, for example, instead of the V-shaped protruding member (9) and by modifying the M spring (24) so that it looks like an inverted V shape, for example, instead of the M shape, in order to serve as a locking protruding member, in tum. For example, FIG. 5 shows a locking spring (6) comprising a hollow part having an inverted M shape and a second spring (54) forming an inverted V.

According to an other embodiment, the housing (1) could be fixed in the heel (10) and the mortise piece (22) could be fixed under the shoe, by modifying their shape in a suitable manner.

The embodiment of the invention is therefore possible in different ways. We have chosen to show, as an example, the simplest and most advantageous realization.

The present invention is not limited to the embodiment described and shown only by way of example, but a person skilled in the art will know how to carry out any better variant thanks to its knowledge.

The device of this invention is particularly meant to manufacture a pair of shoes with interchangeable heels in a simple and not expensive way and in order to be easy to use.

The invention claimed is:

1. Device for interchangeable heeled shoes comprising:

a housing, a flat locking spring locked in the housing, a removable heel, a mortise piece comprising a notch, and configured to fit on the housing, and a second flat spring locked in the notch of the mortise piece, configured to be compatible with the flat locking spring.

2. The device according to claim 1, wherein the housing is configured to be fixed to an insole or machined under a sole of the shoe and the mortise piece is fixed or machined in the removable heel.

3. The device according to claim 1, wherein the housing is configured to be fixed to an insole of the shoe by at least one fastener and the mortise piece is fixed to the removable heel by at least one fastener.

4. The device according to claim 3, wherein the at least one fastener fixing the housing to the insole includes a screw, and wherein the at least one fastener fixing the mortise piece to the removable heel includes a screw.

5. The device according to claim 1, wherein the flat locking spring comprises a locking protruding member, an upper bent part to be locked in a housing notch in the housing, and a folded tab for grasping externally.

6. The device according to claim 5, wherein the second flat spring is a flat spring folded at least three times to have a shape adapted to receive the protruding member of the flat locking spring.

7. The device according to claim 6, wherein the second spring is further folded at each end of the second spring in order to create a locking bent part at each of the ends allowing the second spring to be locked in the notch of the mortise piece.

8. The device according to claim 5, wherein the locking protruding member is constructed and arranged so that the locking protruding member does not jam a sliding of the housing in the mortise piece.

9. The device according to claim 6, wherein the shape having two arches or peaks.

10. The device according to claim 1, wherein the flat locking spring comprises a shape having two valleys, and wherein the second spring forms an inverted V serve as a locking protruding part.

11. The device according to claim 1, wherein an interlocking movement of the mortise piece on the housing is a transverse movement from rear to front of the device.

* * * * *